United States Patent [19]

Zink

[11] 3,942,487

[45] Mar. 9, 1976

[54] INTERNAL COMBUSTION ENGINE-PREFERABLY OF IN-LINE CONSTRUCTION, ESPECIALLY FOR MOTOR VEHICLES

[75] Inventor: Anton Zink, Fellbach, Wurttemberg, Germany

[73] Assignee: Daimler-Benz Aktiengesellschaft, Germany

[22] Filed: Dec. 13, 1968

[21] Appl. No.: 783,587

[30] Foreign Application Priority Data

Dec. 13, 1967 Germany ..... 1576713

[52] U.S. Cl. ..... 123/41.79; 123/41.28; 123/41.74

[51] Int. Cl.[2] ..... F02F 1/14; F02B 75/18

[58] Field of Search ..... 123/41.74, 41.79, 41.81, 123/41.28

[56] References Cited

UNITED STATES PATENTS

| | | | |
|---|---|---|---|
| 1,159,708 | 12/1914 | Rathburn | 123/90.25 |
| 1,744,184 | 1/1928 | Wahlberg | 123/41.71 |
| 2,494,742 | 1/1950 | Buske | 123/173 |
| 3,022,775 | 2/1962 | Bouvy | 123/41.82 |
| 3,173,407 | 3/1965 | Sampietro | 123/41.82 |
| 3,385,273 | 5/1968 | Baster | 123/41.74 |

FOREIGN PATENTS OR APPLICATIONS

| | | |
|---|---|---|
| 309,902 | 5/1917 | Germany |
| 618,094 | 6/1926 | France |
| 809,529 | 3/1959 | United Kingdom |
| 644,395 | 11/1927 | France |

*Primary Examiner*—Charles J. Myhre
*Assistant Examiner*—Ronald B. Cox
*Attorney, Agent, or Firm*—Craig & Antonelli

[57] ABSTRACT

An internal combustion engine, preferably of in-line construction, in which the cylinders are cast together at least pair-wise, a cylinder head is mounted on the cylinder block, and additional passages are provided for the cooling water between the cast together cylinders in the area adjacent the separating surface.

5 Claims, 6 Drawing Figures

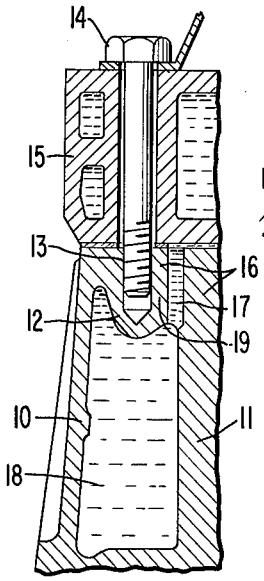
FIG. 1
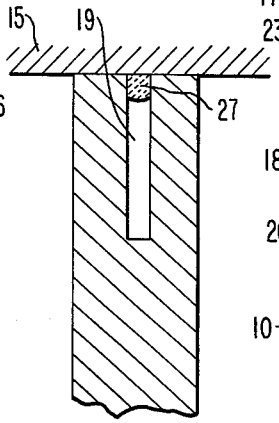
FIG. 6
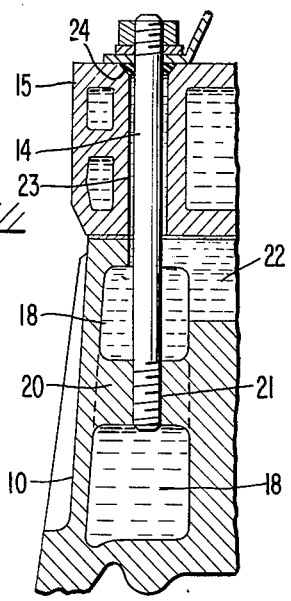
FIG. 3
FIG. 2
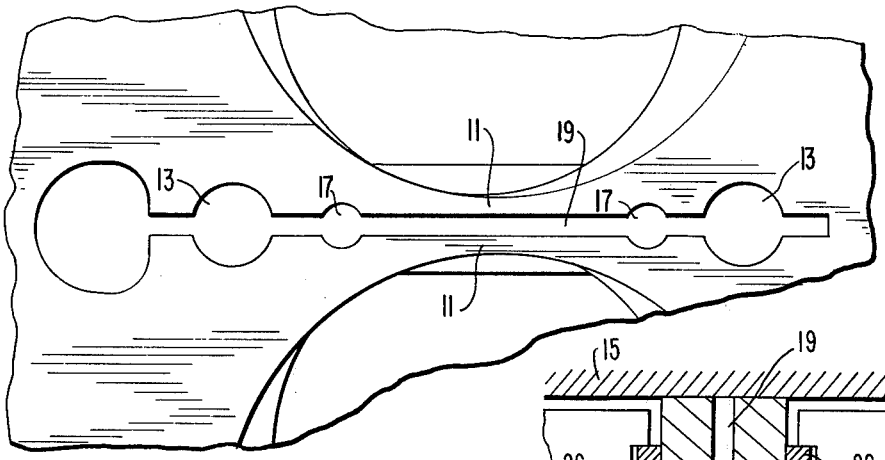
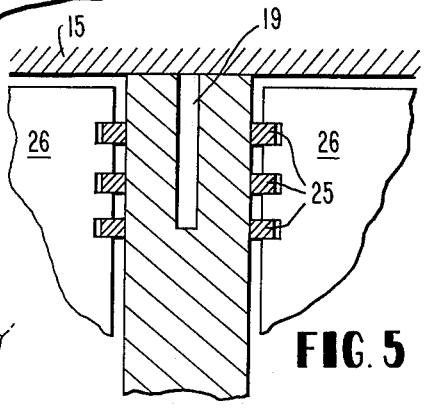
FIG. 5
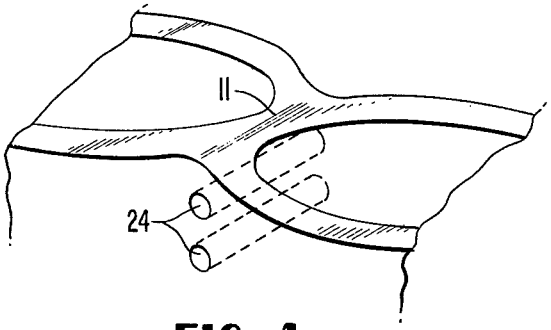
FIG. 4
INVENTOR
ANTON ZINK
BY Craig & Antonelli

INTERNAL COMBUSTION ENGINE-PREFERABLY OF IN-LINE CONSTRUCTION, ESPECIALLY FOR MOTOR VEHICLES

The present invention relates to an internal combustion engine, preferably of in-line construction, especially for motor vehicles in which the cylinders are cast together at least pair-wise and in which the cylinder head or cylinder heads are mounted on the cylinder block.

With internal combustion engines, the cylinders are frequently cast together in the manner described above in order to enconomize structural length. With these known prior art internal combustion engines, excessively high temperatures occur frequently in the upper area of the cylinder walls so that a high wear occurs and additionally the piston rings suffer. Therebeyond, sealing difficulties arise, and under certain circumstances, a warping of the cylinder bore will also occur which again has as a consequence, a higher oil consumption and gas leakage.

The present invention aims at avoiding the aforementioned disadvantages. Primarily a decrease of the temperatures occurring in the upper cylinder area is to be achieved by the present invention. The underlying problems are solved in accordance with the present invention with the internal combustion engines of the type described above in that additional passages of the cooling water are arranged between the cast-together cylinders in the area adjacent the separating surface.

A very considerable temperature decrease is achieved in the area of the upper cylinder walls by the measures proposed in accordance with the present invention. The described wear appearances as well as the feared cylinder warping are avoided thereby. The temperature decrease may reach considerable values, for example, up to 80° C and above if, according to a preferred further feature of the present inventive concept, the cast-together cylinder walls are completely separated in the upper area by a narrow slot which intersects the adjacent cooling water spaces or passages. The additional advantage of a subsequent installation also with known internal combustion engines results therefrom. The decrease of the temperatures at the cylinder wall acts advantageously on the piston rings. No expensive molybdenum rings or double-trapezodal rings need be used any more, and cast-in ring carriers or ring-supports are no longer necessary in the pistons. Less oil carbon is formed in the ring portions and such engines can be operated with commercially available, regular oil.

A further essential feature of the present invention resides in that the slots have such a depth which corresponds at least approximately to that of the piston ring arrangement at the piston. Furthermore, the slot—in order to achieve a more simple manufacture—may extend laterally up to the bores intended for the accommodation of the cylinder head bolts.

In one construction of the described, preferred embodiment of the inventive concept, the slots are open in the direction toward the separating plane up to the cylinder head and are covered or sealed off exclusively by the cylinder head seal. A very good cooling of the seal is achieved thereby. Another type of construction provides that the slots are closed in the direction toward the cylinder head, at the separating plane, for example, are welded together.

Finally, another embodiment of the inventive concept of the present invention resides in that the cooling water spaces disposed on both sides of the cast-together cylinder walls are connected by one or several transversely extending bores. The present invention thereby preferably contemplates two bores of relatively slight diameter which extend through the cast-together cylinder walls. As determined by exhaustive tests, a temperature decrease of about 40°C and thereabove can be achieved with this type of construction.

Accordingly, it is an object of the present invention to provide an internal combustion engine of the type described above, especially for motor vehicles which avoids by simple means the aforementioned shortcomings and drawbacks encountered in the prior art.

Another object of the present invention resides in an internal combustion engine, particular of in-line construction in which excessive temperatures are avoided in the upper area of the cylinder walls.

A further object of the present invention resides in an internal combustion engine in which high wear of the cylinder walls in the upper area of the cylinders as well as of the piston rings is effectively avoided.

Still a further object of the present invention resides in an internal combustion engine of the type described above which minimizes sealing difficulties while avoiding high oil consumption and gas leakages.

Another object of the present invention resides in an internal combustion engine achieving all of the aforementioned aims and objects which is such that the present invention can be applied also to already existing engines.

These and further objects, features, and advantages of the present invention will become more obvious from the following description when taken in connection with the accompanying drawing which shows, for purposes of illustration only, several embodiments in accordance with the present invention, and wherein:

FIG. 1 is a partial cross-sectional view through the cast-together cylinders of a prior art internal combustion engine with the slots of the present invention indicated therein;

FIG. 2 is a partial plan view, on an enlarged scale, on the separating surface of the slotted construction according to FIG. 1, illustrating the various parts in perspective view;

FIG. 3 is a partial cross-sectional view, similar to FIG. 1, through a modified embodiment of an internal combustion engine in accordance with the present invention;

FIG. 4 is a somewhat schematic, partial perspective view of a still further modified embodiment in accordance with the present invention indicating the location of the cross bores in relation to the cylinders;

FIG. 5 is a partial, cross-sectional view through the cast-together cylinders of an internal combustion engine showing the slot in accordance with the present invention; and FIG. 6 is a partial, cross-sectional view, similar to FIG. 5, through a modified embodiment, wherein the slots are closed in the direction toward the cylinder head at the separating plane by being welded together.

Referring now to the drawing wherein like reference numerals are used throughout the various views to designate like parts, and more particularly to FIG. 1, the cylinder walls in the part 11 of the cylinder block 10 disposed between the cylinders are cast together. Cast-together thereby are also extensions 12 (FIG. 1)

into which are cut threaded bores 13 which serve for the accommodation of the cylinder head bolts 14. The cylinder head 15 is mounted on the cylinder block 10 in a conventional manner.

With the described internal combustion engine, excessively high temperatures occur at the places designated by reference numeral 16 which are also not reduced by the relatively thin cooling water bore 17 which leads from the cooling water space 18 to the separating surface between cylinder block 10 and cylinder head 15. The described disadvantages occur as a result of these high temperatures.

In order to avoid these disadvantages, a narrow slot 19 is milled into the cylinder block 10 from the separating surface thereof by means of a conventional miller which is indicated in FIG. 1 in dash and dot lines and is illustrated more fully in FIG. 2. The slot 19 completely separates the cast-together part 11 of the cylinder wall. It extends up to a depth which corresponds approximately to the piston ring arrangement 25 at the piston as shown in FIG. 5, wherein pistons 26 are shown at the top dead center position. Laterally, the slot 19 intersects the passage bores 17 for the cooling water and may extend even into the threaded bores 13.

By means of this narrow slot—its width may amount, for example, to only 3mm.—the cooling water is able to enter from the passage bore 17 into the narrowest place between the cylinder walls, i.e., into the part 11. In this manner, an intensive cooling is achieved thereat. The temperatures of the cylinder walls are decreased by considerable amounts.

With internal combustion engines which do not possess any passage bores 17, the slot is so laid out as to depth and lateral extent that it intersects in every case the adjoining cooling water spaces. In the illustrated embodiment the slot 19 is open in the upward direction, i.e., in the direction toward the separating surface. The cylinder head seal is cooled well in this manner. Gas leakages do not occur at the seal, in contrast, as a result of the increased surface pressure at the sealing surfaces reduced by the slot 19, an excellent seal is assured.

The slot described above can be machined without any difficulty subsequently into an already existing internal combustion engine. If the same measure is constructively provided beforehand at the engine, a construction according to FIG. 3 will be preferred. In this arrangement, the cylinder head bolts 14 are extended and reach into an extension or shoulder 20 which is arranged by a relatively large amount below the separating surface facing the head. This means, expressed in other words, the cooling water space 18 contains approximately at half its height several extensions 20 into which are then machined the mounting bores 21 for the cylinder head bolts 14.

The now cast-in slot 22 has in principle the same extent and dimension and position as described already hereinabove. The cooling is further improved in this embodiment because a larger passage is available between the cooling water space 18 and the slot 22. The cooling water now enters into the bore 23 intended for receiving the cylinder head bolt 14 in the cylinder head 15. The bore 23 is therefore sealed off at the top by a conventional seal 24. The basic construction and also the basic operation of this arrangement is exactly the same as described hereinabove with reference to the embodiment according to FIGS. 1 and 2.

According to FIG. 4, two cross bores 24 are arranged in the cast-together part 11 of the cylinder walls in the upper area thereof. These cross bores 24 may have a relatively slight diameter, for example, 4 mm. They inter-connect the cooling water spaces on both sides of the cylinder walls and therefore have as a consequence also a better cooling in the upper area of the cast-together together wall parts. The temperature decrease achievable thereby at this place, however, is not as large as with the arrangement described in FIGS. 1 to 3.

FIG. 6 shows another type of construction wherein the slot 19 is closed in the direction toward the cylinder head 15, at the separating plane, by being welded together as designed by the numeral 27.

While I have shown and described several embodiments in accordance with the present invention, it is understood that the same is not limited thereto but is susceptible of numerous changes and modifications as known to a person skilled in the art, and I therefore do not wish to be limited to the details shown and described herein but intend to cover all such changes and modifications as are within the scope of those skilled in the art.

I claim:

1. An internal combustion engine, especially for motor vehicles, which includes cylinder block means forming with cylinder walls thereof cylinder means cast together at least pair-wise with the cylinder walls in the portion of the cylinder block means disposed between adjacent cylinder means integrally cast together along substantially the entire length thereof, characterized in that the engine is of in-line construction, passage means for cooling water being arranged between the cast-together cylinder means in the area adjacent the surface separating the cylinder block means from a cylinder head, said passage means including narrow slot means, which has a depth corresponding at least approximately to that of a piston ring arrangement of the piston at top dead-center position, intersecting adjacent cooling water spaces and completely separating, in a lateral direction of the cylinder walls, said portion of the cast-together cylinder means, and wherein the slot means extends laterally into the cylinder head bolt bores at the interface between the cylinder block means and the cylinder head.

2. An internal combustion engine according to claim 1, wherein the adjacent cooling water spaces are formed by cooling water passages.

3. An internal combustion engine according to claim 1 wherein the slot means are open toward the separating surface in the direction toward the cylinder head means and are covered only by a cylinder head seal means.

4. An internal combustion engine according to claim 1, wherein the slot means are closed in the direction toward the cylinder head means at the separating surface plane.

5. An internal combustion engine according to claim 4, wherein the slot means is closed by welding.

* * * * *